US010104914B2

(12) United States Patent
Force

(10) Patent No.: US 10,104,914 B2
(45) Date of Patent: Oct. 23, 2018

(54) AIRFLOW IN AEROSOL GENERATING SYSTEM WITH MOUTHPIECE

(71) Applicant: Eric Force, Bevaix (CH)

(72) Inventor: Eric Force, Bevaix (CH)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 15/474,266

(22) Filed: Mar. 30, 2017

(65) Prior Publication Data

US 2017/0280774 A1 Oct. 5, 2017

Related U.S. Application Data

(63) Continuation of application No. PCT/EP2017/054414, filed on Feb. 24, 2017.

(30) Foreign Application Priority Data

Mar. 31, 2016 (EP) ..... 16163361

(51) Int. Cl.
*A24F 13/00* (2006.01)
*A24F 47/00* (2006.01)

(52) U.S. Cl.
CPC ..... *A24F 47/008* (2013.01)

(58) Field of Classification Search
CPC ..... A61M 11/042; A61M 2005/006; A24F 47/008; A24F 47/002
USPC ..... 131/328, 329
See application file for complete search history.

(56) References Cited

U.S. PATENT DOCUMENTS 5,540,241 A * 7/1996 Kim ..... A24F 13/06 131/173
2011/0277760 A1* 11/2011 Terry ..... A24F 47/008 128/203.12
2015/0034103 A1* 2/2015 Hon ..... H05B 3/22 131/328
2015/0114409 A1* 4/2015 Brammer ..... H05B 3/02 131/329
2016/0021930 A1* 1/2016 Minskoff ..... A61M 15/06 131/329
2016/0219934 A1 8/2016 Li et al.
(Continued)

FOREIGN PATENT DOCUMENTS

CN 104738816 A 7/2015
WO WO-2013083635 A1 6/2013
WO WO-2013/155645 A1 10/2013
(Continued)

OTHER PUBLICATIONS

International Search Report and Written Opinion for International Application No. PCT/EP2017/054414 and dated May 11, 2017.
(Continued)

*Primary Examiner* — Abdullah Riyami
*Assistant Examiner* — Thang Nguyen
(74) *Attorney, Agent, or Firm* — Harness, Dickey & Pierce, P.L.C.

(57) ABSTRACT

An aerosol generating system includes a liquid storage portion, a liquid transfer element, a power supply, and a heating element operably coupled to the power supply and configured to heat the aerosol generating substrate. The system also includes a cover over the liquid storage portion.

16 Claims, 10 Drawing Sheets

(56) References Cited

U.S. PATENT DOCUMENTS

2016/0270442 A1* 9/2016 Liu ..... A24F 47/008

FOREIGN PATENT DOCUMENTS

WO WO-2013/160112 A2 10/2013
WO WO-2015/120588 A1 8/2015

OTHER PUBLICATIONS

Extended European Search Report dated Sep. 7, 2016 for corresponding European Application No. 16163361.5.

* cited by examiner

AIRFLOW IN AEROSOL GENERATING SYSTEM WITH MOUTHPIECE

This is a continuation of and claims priority to PCT/EP2017/054414 filed on Feb. 24, 2017, and further claims priority to EP 16163361.5 filed on Mar. 31, 2016; both of which are hereby incorporated by reference in their entirety.

BACKGROUND

At least one example embodiment relates to electrically heated aerosol generating systems and associated devices, articles and methods.

One type of aerosol generating system is an electrically operated elongate handheld aerosol generating system, having a mouth end and a distal end. Handheld electrically operated aerosol generating systems may include a device portion comprising a battery and control electronics, a cartridge portion comprising a supply of aerosol generating substrate, and an electrically operated vaporizer. The vaporizer may comprise a coil of heater wire wound around an elongate wick soaked in liquid aerosol generating substrate. A cartridge comprising both a supply of aerosol generating substrate and a vaporizer is sometimes referred to as a "cartomizer."

The cartridge comprising the aerosol generating substrate may include a central passage through which the aerosol flows. When an adult vaper draws on the mouth end of the system, air is typically drawn into the vaporizer, and the entire air flow is directed through the vaporizer, then through a central passage of the cartridge and to the mouth end of the system. It has been identified in some cases that condensation may form on an exterior surface of the cartridge. When the mouthpiece is removed to replace the spent cartridge, the adult vaper may experience an unpleasant sensation when grasping the moist cartridge.

SUMMARY

At least one example embodiment relates to an aerosol generating system having a mouth end and a distal end. The system comprises a liquid storage portion suitable for containing an aerosol generating substrate, as well as a heating element, a cover disposed over and spaced from the liquid storage portion, and one or more air flow channels between the cover and the liquid storage portion. The system defines an aerosol flow path that extends at least from the heating element to the mouth end of the system. The system also defines an air flow path through the one or more channels extending from at least the liquid storage portion to the mouth end of the system.

In at least one example embodiment, the systems may serve to reduce the formation of condensation or moisture on an exterior of a cartridge or other liquid storage portion in such a system.

In at least one example embodiment, when the cover is secured in a position relative to the liquid storage portion, the cover and the liquid storage portion may cooperate to form one or more channels between the cover and the liquid storage portion through which air may flow. Such air flow may pass over an exterior surface of the liquid storage portion and may serve to reduce condensation that may otherwise occur on surfaces of either or both of the liquid storage portion and the cover. In at least one example embodiment, one or both of the inner surface of the cover and the outer surface of the liquid storage portion may include one or more protrusions or detents, such as ridges, that define one or more air channels when the cover is over the liquid storage portion. In addition or alternatively, a separate piece or pieces may be inserted between the cover and the liquid storage portion to form suitably sized channels between the cover and the liquid storage portion.

The one or more air channels may reduce formation of condensation on device surfaces accessible to the adult vaper compared with a device where there is substantially no air flow between the liquid storage element and the cover. This may improve the adult vaper experience when changing a cartridge or capsule to replace depleted liquid substrate in the liquid storage portion. In addition, the presence of the air flow path in the systems according to at least one example embodiment allows overall resistance to draw of the system to be tailored.

BRIEF DESCRIPTION OF THE DRAWINGS

Embodiments will now be described, by way of example only, with reference to the accompanying drawings

Figure 1A:
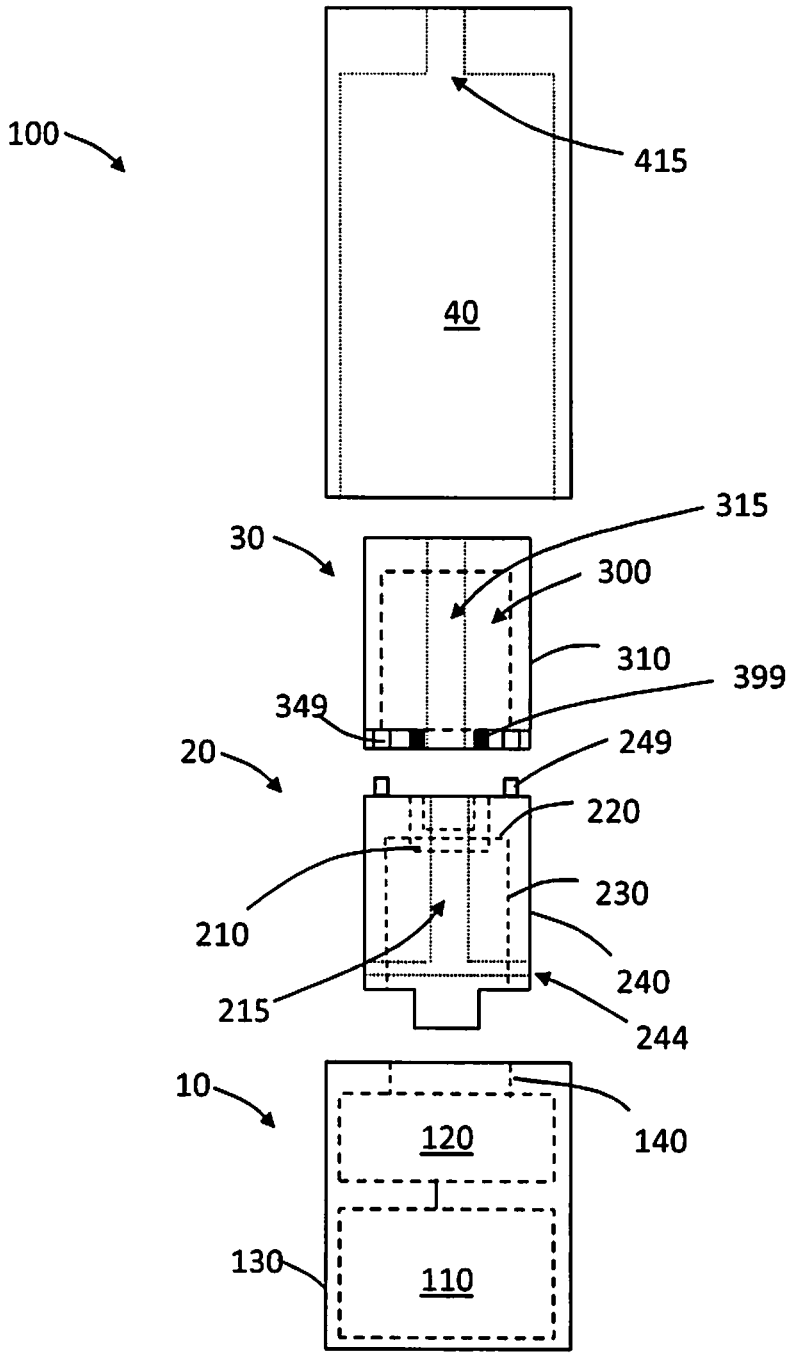
FIG. 1A is a side view of disconnected parts and cover of an aerosol generating system according to at least one example embodiment.

The schematic drawings are not necessarily to scale and are presented for purposes of illustration and not limitation.

DETAILED DESCRIPTION

Various example embodiments will now be described more fully with reference to the accompanying drawings in which some example embodiments are shown. However, specific structural and functional details disclosed herein are merely representative for purposes of describing example embodiments. Thus, the embodiments may be embodied in many alternate forms and should not be construed as limited to only example embodiments set forth herein. Therefore, it should be understood that there is no intent to limit example embodiments to the particular forms disclosed, but on the contrary, example embodiments are to cover all modifications, equivalents, and alternatives falling within the scope.

In the drawings, the thicknesses of layers and regions may be exaggerated for clarity, and like numbers refer to like elements throughout the description of the figures.

Although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that, if an element is referred to as being "connected" or "coupled" to another element, it can be directly connected, or coupled, to the other element or intervening elements may be present. In contrast, if an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," if used herein, specify the presence of stated features, integers, steps, operations, elements and/or components, but do not preclude the presence or addition of one or more other features, integers, steps, operations, elements, components and/or groups thereof.

Spatially relative terms (e.g., "beneath," "below," "lower," "above," "upper" and the like) may be used herein for ease of description to describe one element or a relationship between a feature and another element or feature as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, for example, the term "below" can encompass both an orientation that is above, as well as, below. The device may be otherwise oriented (rotated 90 degrees or viewed or referenced at other orientations) and the spatially relative descriptors used herein should be interpreted accordingly.

Example embodiments are described herein with reference to cross-sectional illustrations that are schematic illustrations of idealized embodiments (and intermediate structures). As such, variations from the shapes of the illustrations as a result, for example, of manufacturing techniques and/or tolerances, may be expected. Thus, example embodiments should not be construed as limited to the particular shapes of regions illustrated herein but may include deviations in shapes that result, for example, from manufacturing. For example, an implanted region illustrated as a rectangle may have rounded or curved features and/or a gradient (e.g., of implant concentration) at its edges rather than an abrupt change from an implanted region to a non-implanted region. Likewise, a buried region formed by implantation may result in some implantation in the region between the buried region and the surface through which the implantation may take place. Thus, the regions illustrated in the figures are schematic in nature and their shapes do not necessarily illustrate the actual shape of a region of a device and do not limit the scope.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Although corresponding plan views and/or perspective views of some cross-sectional view(s) may not be shown, the cross-sectional view(s) of device structures illustrated herein provide support for a plurality of device structures that extend along two different directions as would be illustrated in a plan view, and/or in three different directions as would be illustrated in a perspective view. The two different directions may or may not be orthogonal to each other. The three different directions may include a third direction that may be orthogonal to the two different directions. The plurality of device structures may be integrated in a same electronic device. For example, when a device structure (e.g., a memory cell structure or a transistor structure) is illustrated in a cross-sectional view, an electronic device may include a plurality of the device structures (e.g., memory cell structures or transistor structures), as would be illustrated by a plan view of the electronic device. The plurality of device structures may be arranged in an array and/or in a two-dimensional pattern.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Unless specifically stated otherwise, or as is apparent from the discussion, terms such as "processing" or "computing" or "calculating" or "determining" or "displaying" or the like, refer to the action and processes of a computer system, or similar electronic computing device, that manipulates and transforms data represented as physical, electronic quantities within the computer system's registers and memories into other data similarly represented as physical quantities within the computer system memories or registers or other such information storage, transmission or display devices.

As disclosed herein, the term "storage medium", "computer readable storage medium" or "non-transitory computer readable storage medium," may represent one or more devices for storing data, including read only memory (ROM), random access memory (RAM), magnetic RAM, core memory, magnetic disk storage mediums, optical storage mediums, flash memory devices and/or other tangible machine readable mediums for storing information. The term "computer-readable medium" may include, but is not limited to, portable or fixed storage devices, optical storage devices, and various other mediums capable of storing, containing or carrying instruction(s) and/or data.

Furthermore, at least some portions of example embodiments may be implemented by hardware, software, firmware, middleware, microcode, hardware description languages, or any combination thereof. When implemented in software, firmware, middleware or microcode, the program code or code segments to perform the necessary tasks may be stored in a machine or computer readable medium such as a computer readable storage medium. When implemented in software, processor(s), processing circuit(s), or processing unit(s) may be programmed to perform the necessary tasks, thereby being transformed into special purpose processor(s) or computer(s).

A code segment may represent a procedure, function, subprogram, program, routine, subroutine, module, software package, class, or any combination of instructions, data structures or program statements. A code segment may be coupled to another code segment or a hardware circuit by passing and/or receiving information, data, arguments, parameters or memory contents. Information, arguments, parameters, data, etc. may be passed, forwarded, or transmitted via any suitable means including memory sharing, message passing, token passing, network transmission, etc.

In order to more specifically describe example embodiments, various features will be described in detail with reference to the attached drawings. However, example embodiments described are not limited thereto.

At least one example embodiment relates to aerosol generating system. In at least one example embodiment, the aerosol generating systems use electrical energy to heat a substrate, without combusting the substrate, to form an aerosol. In at least one example embodiment, the systems are sufficiently compact to be considered hand-held systems. In at least one example embodiment, the systems can form a nicotine-containing aerosol.

The term "aerosol generating" article, system or assembly refers to an article, system or assembly comprising an aerosol generating substrate that releases volatile compounds to form an aerosol. The term "aerosol generating substrate" refers to a substrate capable of releasing, upon heating, volatile compounds, which may form an aerosol.

Any suitable aerosol generating substrate may be used with the systems. Suitable aerosol generating substrates may comprise plant-based material. In at least one example embodiment, an aerosol generating substrate may comprise tobacco or a tobacco-containing material containing volatile tobacco flavor compounds, which are released from the aerosol generating substrate upon heating. In addition or alternatively, an aerosol generating substrate may comprise a non-tobacco containing material. An aerosol generating substrate may comprise homogenized plant-based material. An aerosol generating substrate may comprise at least one aerosol former. An aerosol generating substrate may comprise other additives and ingredients such as flavorants. In at least one example embodiment, an aerosol generating substrate comprises nicotine. In at least one example embodiment, an aerosol generating substrate is liquid at room temperature. In at least one example embodiment, an aerosol generating substrate may be a liquid solution, suspension, dispersion or the like. In at least one example embodiment, an aerosol generating substrate comprises glycerol, propylene glycol, water, nicotine and, optionally, one or more flavorant.

The aerosol generating substrate is stored in the liquid storage portion of a system. The liquid storage portion may be a consumable part, which the adult vaper can replace when the supply of the aerosol generating substrate in the liquid storage portion is diminished or depleted. In at least one example embodiment, a depleted liquid storage portion can be replaced with another liquid storage portion at least partially filled with aerosol generating substrate. In at least one example embodiment, the liquid storage portion is not refillable by an adult vaper.

A single part may include the liquid storage portion and a heating element of an aerosol generating system. Such liquid storage portions may be referred to herein as "cartridges." In at least one example embodiment, a liquid storage portion may be a module that is releasably connectable to a module having a heating element. Modules having heating elements, which are separate modules from the liquid storage portion, may be referred to as "vaporizing units." Liquid storage portions that do not integrally include a heating element may be referred to as "capsules." One example of a capsule that may be employed is a liquid storage portion described for example in Chinese Patent Application Publication No. 104738816A, filed 4 Feb. 2015. This publication describes an electronic aerosol generating assembly having a detachably connected liquid storage portion and vaporizing assembly. In at least one example embodiment, the system also comprises a liquid transfer element suitable for transferring liquid aerosol generating substrate to the heating element.

Aerosol generating systems may have any suitable overall resistance to draw. In at least one example embodiment, the systems may have a resistance-to-draw (RTD) in a range from about 50 mm water (gauge) (mmWG) to about 150 mmWG. In at least one example embodiment, the systems have a resistance-to-draw in a range from about 65 mmWG to about 115 mmWG, from about 75 mmWG to about 110 mmWG, or from about 80 mmWG to about 100 mmWG. The RTD of an aerosol generating article refers to the static pressure difference between the two ends of the specimen when it is traversed by an air flow under steady conditions in which the volumetric flow is 17.5 milliliters per second at the output end. The RTD of a specimen can be measured using the method set out in ISO Standard 6565:2002.

Air flow through the aerosol path can transfer heat away from the heating element so as to cool the heating element and other heated parts in the aerosol path, which can extend the life of the parts and maintain desired temperatures. Accordingly, in some example embodiments, the air flow through the aerosol path is supplemented by further air which has passed between the liquid storage element and the cover. Thus, in some example embodiments, air passes to the outlet of the device by at least two routes, and by controlling the amount of air through each route, the RTD or the characteristics of the generated aerosol can be controlled. Some example embodiments allow for sufficient flow through the aerosol path to maintain desired temperatures in the systems, particularly at or in proximity to the heating elements, while also allowing for air flow through the air flow path around the liquid storage portion to provide the desired RTD in the system.

The air flow path and the aerosol flow path may mix at the outlet or upstream of the outlet.

Aerosol generating systems may incorporate any of a variety of suitable types of heating elements. The type of heating elements used may influence the overall design of the airflow management, including the volume of air passing through each of the respective passageways, the air flow path and the aerosol flow path. In at least one example embodiment incorporating airflow bypassing the heating element, and using a standard type of coil and wick heating element, the volume of air passing through the air flow path is smaller than the volume of air passing through the aerosol path when an adult vaper draws on the mouth end of the article. In at least one example embodiment, the volume of air passing through the aerosol flow path may be about 3 times to about 8 times the air volume through the air flow path. In at least one example embodiment, the volume of air passing through the aerosol flow path is about 5 times to about 7 times the air volume through of the air flow path. The air flow management may be designed with these ratios to yield an RTD measured at the mouthpiece in the suitable ranges described above.

The RTD through a flow path can be modified in any suitable manner. In at least one example embodiment, RTD can be varied by adjusting the size and number of inlets and outlets, or the length and dimensions of the flow path.

In at least one example embodiment, the systems include a capsule releasably connectable to a vaporizing unit. As used herein, "releasably connectable" means that the releasable connectable parts may be connected to, and disconnected from each other, without significantly damaging either part. A capsule may be connected to a vaporizing unit in any suitable manner, such as threaded engagement, snap-fit engagement, interference-fit engagement, magnetic engagement, or the like.

If the system comprises a separate vaporizing unit and capsule, the capsule may comprise a valve positioned relative to a distal end portion opening to prevent the aerosol generating substrate from exiting the reservoir when the capsule is not connected to the vaporizing unit. The valve may be actuatable such that the act of connecting the capsule to the vaporizing unit causes the valve to open and disconnecting the capsule from the vaporizing unit causes the valve to close. Any suitable valve may be used. One suitable valve is described in Chinese Patent Application Publication No. CN 104738816 A and U.S. Patent Publication No. 2016/0219934 both to Li, which describe a rotary valve assembly, the entire contents of each of which is incorporated herein by reference thereto. In the rotary valve assembly, a rotatable valve including a liquid outlet is arranged at an outlet end of a liquid storage element. A connection element is provided which can be arranged in the liquid outlet of the valve. Rotation of the connection element on connection of the liquid storage element effects rotation of the valve to align the liquid outlet of the valve with an outlet of a liquid reservoir to allow passage of the liquid from the reservoir to a liquid inlet associated with a heater element. When the liquid storage element is removed, rotation of the connection element rotates the valve back to seal the liquid outlet of the reservoir.

The liquid storage portion comprises a housing, which may be a rigid housing. As used herein "rigid housing" means a housing that is self-supporting. The housing may be formed of any suitable material or combination of materials, such as a polymeric material, a metallic material, or a glass. In at least one example embodiment, the housing of the liquid storage portion is formed by a thermoplastic material. Any suitable thermoplastic material may be used. In at least one example embodiment, a passage is defined through the housing that forms at least a portion of the aerosol flow path.

If the system comprises a separate vaporizing unit, the vaporizing unit comprises a housing in which the heating element and, optionally a liquid transfer element, are disposed. The vaporizing unit may include an element that interacts with the valve of the cartridge to open the valve and place the heating element, and optionally the liquid transfer element, in fluid communication with the aerosol generating substrate when the capsule is connected to the vaporizing unit. The housing of the vaporizing unit is a rigid housing. In at least one example embodiment, at least a portion of the housing comprises a thermoplastic material, a metallic material, or a thermoplastic material and a metallic material. In at least one example embodiment, a passage is defined through the housing that forms at least a portion of the aerosol flow path.

The liquid storage portion, regardless of whether it is a cartridge or capsule, may comprise a liquid transfer material in contact with the aerosol generating substrate. A "liquid transfer material" is a material that actively conveys liquid from one end of the material to another, for example by capillary action, such as a wick. The liquid transfer material may be oriented to convey liquid aerosol generating substrate to a liquid transfer element, if present, in the cartridge or vaporizing unit.

Liquid transfer material may have a fibrous or spongy structure. In at least one example embodiment, liquid transfer material includes a web, mat or bundle of fibers. The fibers may be generally aligned to convey the liquid in the aligned direction. In at least one example embodiment, the liquid transfer material may comprise sponge-like or foam-like material. The liquid transfer material may comprise any suitable material or combination of materials. Examples of suitable materials are a sponge or foam material, ceramic- or graphite-based materials in the form of fibers or sintered powders, a fibrous material, for example made of spun or extruded fibers, or ceramic or glass.

If the system includes a liquid transfer element configured to transfer aerosol generating substrate to a heating element, at least a portion of the liquid transfer element is located sufficiently close to the heating element so that liquid aerosol generating substrate carried by the liquid transfer element may be heated by the heating element to generate an aerosol. In at least one example embodiment, the liquid transfer element is in contact with the heating element.

Any suitable heating element may be employed. For example, the heating element may comprise a resistive filament. The term "filament" refers to an electrical path arranged between two electrical contacts. A filament may arbitrarily branch off and diverge into several paths or filaments, respectively, or may converge from several electrical paths into one path. A filament may have a round, square, flat or any other form of cross-section. A filament may be arranged in a straight or curved manner. One or more resistive filament may form a coil, mesh, array, fabric or the like. Application of an electric current to the heating element results in heating due to the resistive nature of the element. In at least one example embodiment, the heating element forms a coil that is wrapped around a portion of the liquid transfer element.

A heating element may comprise any suitable electrically resistive filament. In at least one example embodiment, a heating element may comprise a nickel-chromium alloy.

One or more air inlet may be formed in the housing of the cartridge or a vaporizing unit to allow air to be drawn into the vaporizing unit or cartridge to entrain aerosol resulting from the heating of the aerosol generating substrate. In at least one example embodiment, an inlet may be formed in a part housing a power supply and an internal passage can guide air from the inlet to the cartridge or vaporizing unit. The aerosol containing stream may then be guided through a passage in the cartridge or capsule to the mouth end of the device.

The vaporizing unit or cartridge may comprise electrical contacts exterior to, exposed through, or effectively formed by the housing of the vaporizing unit or cartridge for electrically coupling the heating element to a power supply or other control electronics in a separate part of the system. The heating element may be electrically coupled to the contacts by any suitable electrical conductor. The contacts may be for formed of any suitable electrically conductive material. In at least one example embodiment, the contacts may comprise nickel- or chromium-plated brass.

The vaporizing unit or the cartridge may be releasably connectable with a part containing the power supply. The vaporizing unit or the cartridge may be connected to the part containing the power supply in any suitable manner, such as threaded engagement, snap-fit engagement, interference-fit engagement, magnetic engagement, or the like.

The part containing the power supply comprises a housing and the power supply disposed in the housing. The part may also comprise electronic circuitry disposed in the housing and electrically coupled to the power supply. The part may comprise contacts exterior to, exposed through, or effectively formed by the housing such that the contacts of the part electrically couple with the contacts of the vaporizing unit or the cartridge when the part is connected with the vaporizing unit or cartridge. The contacts of the part are electrically coupled to the electronic circuitry and power supply. Thus, when the part is connected to the vaporizing unit or cartridge, the heating element is electrically coupled to the power supply and circuitry.

In at least one example embodiment, the electronic circuitry is configured to control delivery of an aerosol resulting from heating of the substrate to an adult vaper. The electronic circuitry can be provided in any suitable form and may, for example, include a controller or a memory and a controller. The controller can include one or more of an Application Specific Integrated Circuit (ASIC) state machine, a digital signal processor, a gate array, a microprocessor, or equivalent discrete or integrated logic circuitry. Control electronic circuitry can include memory that contains instructions that cause one or more parts of the circuitry to carry out a function or aspect of the control circuitry. Functions attributable to control circuitry in this disclosure can be embodied as one or more of software, firmware, and hardware.

The electronic circuitry may be configured to monitor the electrical resistance of the heater element or of one or more filaments of the heating element, and to control the supply of power to the heating element dependent on the electrical resistance of the heating element or the one or more filaments.

The electronic circuitry may comprise a microprocessor, which may be a programmable microprocessor. The electronic circuitry may be configured to regulate a supply of power. The power may be supplied to the heater assembly in the form of pulses of electrical current.

The part that includes the power supply may include a switch configured to activate the system. In at least one example embodiment, the part may include a button that can be depressed to activate or optionally deactivate the system.

The power supply is typically a battery, but may comprise another form of charge storage device such as a capacitor. The power supply may be rechargeable.

The housing of the part containing the power supply is a rigid housing. Any suitable material or combination of materials may be used for forming the rigid housing. Examples of suitable materials include metals, alloys, plastics or composite materials containing one or more of those materials, or thermoplastics that are suitable for food or pharmaceutical applications, for example polypropylene, polyetheretherketone (PEEK), acrylonitrile butadiene styrene and polyethylene.

In at least one example embodiment, an aerosol generating system includes a cover that is disposable over at least the liquid storage portion. In at least one example embodiment, the cover includes a distal end opening that is configured to receive the liquid storage portion. The cover may also extend over at least a portion of the vaporizing unit if the system includes a separate vaporizing unit, and may also extend over at least a portion of a part that contains the power supply. In at least one example embodiment, the system includes a separate capsule and vaporizing unit and the cover extends over the capsule and the vaporizing unit and abuts a proximal end portion of the part containing the power supply. In at least one example embodiment, the cover may extend over the capsule and abut a portion of the vaporizing unit.

In at least one example embodiment, the cover is releasably securable in a position relative to at least the cartridge or capsule. The cover may be releasably connectable to the cartridge or capsule, the vaporizing unit if present, or the part containing the power supply to be retained in a position relative to the cartridge or capsule. The cover may be connected to the liquid storage portion, vaporizing unit or part containing the power supply in any suitable manner, such as threaded engagement, snap-fit engagement, interference-fit engagement, magnetic engagement, or the like.

If the cover extends over an inlet of the vaporizing unit or a portion of the cartridge containing the heating element, a sidewall of the cover may define one or more air inlets to allow air to enter the vaporizing unit or cartridge.

The cover defines the mouth end of the aerosol generating system. In at least one example embodiment, the cover is generally cylindrical and may taper inwardly towards the mouth end. The cover may comprise one part or multiple parts. For example, the cover may include a distal part and a releasable connectable proximal part that may serve as a mouthpiece. The cover defines a mouth end opening to allow aerosol resulting from heating of the aerosol generating substrate to exit the device.

The terms "distal," "upstream," "proximal," and "downstream" are used to describe the relative positions of parts, or portions of parts, of an aerosol generating system. Aerosol generating systems have a proximal end through which an aerosol exits the system, and have an opposing distal end. The proximal end of the aerosol generating article may also be referred to as the mouth end. During vaping, an adult vaper draws on the proximal end of the aerosol generating system. The terms upstream and downstream are relative to the direction of aerosol movement through the aerosol generating system when an adult vaper draws on the proximal end.

The cover and the cartridge or capsule, when the cover is secured in a position relative to the cartridge or capsule, cooperate to form one or more channels between them through which air may flow. This "air flow path" is distinct from the aerosol flow path. In at least one example embodiment, one or both of the inner surface of the cover and the outer surface of the capsule or cartridge may include one or more protrusions or detents, such as ridges, that define one or more channels when the cover is disposed over the capsule or cartridge. In addition or alternatively, a separate piece or pieces may be inserted between the cover and the capsule or cartridge to form suitably sized channels between the cover and the capsule or cartridge. In addition or alternatively, radial clearance between the cover and the liquid storage portion may define a channel through which air may flow.

Each of the aerosol flow path and the air flow path may comprise one or more inlets or outlets. One or more of the inlets and outlets of the aerosol flow path and the air flow path may be distinct or shared between the paths. The one or more outlets of the aerosol flow path and the air flow path are positioned at or near the mouth end of the cover so that when an adult vaper draws on the mouth end flow is generated through the aerosol flow path and the air flow path.

In at least one example embodiment, the air flow path is defined around an exterior surface of the liquid storage portion, and the aerosol flow path is defined through a central passageway through the liquid storage portion. Such a configuration allows the warm aerosol to flow through an interior portion of the cartridge or capsule, while inhibiting the formation of condensation on an exterior surface of the liquid storage portion.

The flow through the air flow path and the aerosol path may be restricted in any suitable manner to provide for a desired overall resistance to draw of the system and the relative flow through the air flow path and the aerosol path. The size and shape of the inlets, the outlets, or channels of the path can be tailored to achieve desired RTDs and relative flows.

The cover comprises an elongate housing, which is rigid. The housing may comprise any suitable material or combination of materials. Examples of suitable materials include metals, alloys, plastics or composite materials containing one or more of those materials, or thermoplastics that are suitable for food or pharmaceutical applications, such as polypropylene, polyetheretherketone (PEEK) and polyethylene.

An aerosol generating system, when all parts are connected, may have any suitable size. In at least one example embodiment, the system may have a length ranging from about 50 mm to about 200 mm. In at least one example embodiment, the system has a length ranging from about 100 mm to about 190 mm. In at least one example embodiment, the system has a length ranging from about 140 mm to about 170 mm.

Reference will now be made to the drawings, which depict one or more features of at least one example embodiment. However, it will be understood that other features not depicted in the drawings fall within the scope and spirit of this disclosure. Like numbers used in the figures refer to like parts, steps and the like. However, it will be understood that the use of a number to refer to a part in a given figure is not intended to limit the part in another figure labeled with the same number. In addition, the use of different numbers to refer to parts in different figures is not intended to indicate that the different numbered parts cannot be the same or similar to other numbered parts.

Figure 1B:
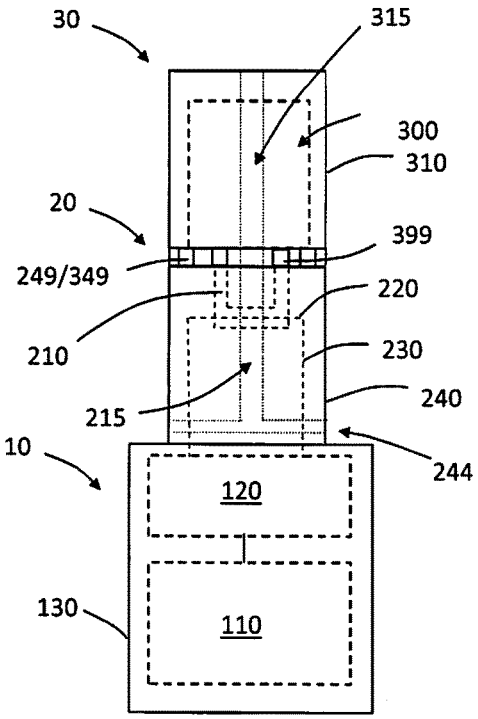
FIG. 1B is a side view of some connected parts illustrating some internal portions of the parts according to at least one example embodiment.
Figure 1C:
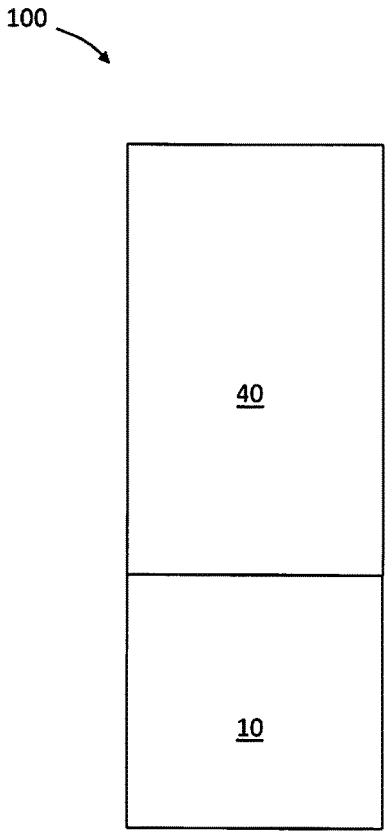
FIG. 1C is a side view of connected parts showing only exterior portions of the cover and part containing a power supply according to at least one example embodiment.

Referring now to FIGS. 1A-C, an aerosol generating system 100 includes a first part 10, a vaporizing unit 20, a capsule 30, and a cover 40. The first part 10 is releasably connectable to the vaporizing unit 20. The vaporizing unit 20 is releasably connectable to the capsule 30. The cover 40 is positionable over the vaporizing unit 20 and capsule 30. The cover 40 is releasably securable in a position relative to the vaporizing unit 20 and capsule 30. In some example embodiments (not depicted), the parts of the vaporizing unit 20 may be included in a cartridge, and the system 100 would not include a separate vaporizing unit.

The first part 10 comprises a housing 130 in which a power supply 110 and electronic circuitry 120 are disposed. The electronic circuitry 120 is electrically coupled to the power supply 110. Electrical conductors 140 may connect contacts (not shown) exposed through, positioned on, or formed by the housing 130.

The vaporizing unit 20 comprises a housing 240 in which a liquid transfer element 210 and a heating element 220 are disposed. The liquid transfer element 210 is in thermal connection with the heating element 220. Electrical conductors 230 electrically couple the heating element 220 to electrical contacts (not shown) exposed through, or positioned on, the housing 240. When the vaporizing unit 20 is connected to the first part 10 (for example, as shown in FIG. 1B), the heating element 220 is electrically coupled with the circuitry 120 and power supply 110.

The capsule 30 comprises a housing 310 defining a reservoir 300 in which a liquid aerosol generating substrate (not shown) is stored. The capsule 30 can be connected to the vaporizing unit 20, for example, by a snap-fit or interference-fit connection, resulting, for example, from the application of force to join the two parts along a longitudinal axis of the system 100. In at least one example embodiment, the capsule 30 and vaporization unit 20 may be connected by a rotational coupling, such as a bayonet-type connection. When the capsule 30 is connected to the vaporizing unit 20, the reservoir 300 and thus the aerosol generating substrate can be either immediately placed, or subsequently engaged, in fluid communication with the liquid transfer element 210. In at least one example embodiment, the capsule 30 may include valves 399 configured to be closed when the vaporizing unit and the capsule are not connected (such as in FIG. 1A) and configured to be open when the vaporizing unit and the capsule are connected (such as in FIG. 1B). The valves 399 are aligned with distal openings in the capsule 30 and proximal openings (not shown) in the vaporizing unit 20 such that when the valves are open, liquid aerosol generating substrate in the reservoir 300 is in communication with liquid transfer element 210.

In at least one example embodiment, upon first connecting the vaporizing unit 20 and the capsule 30, such as by a snap-fit or interference-fit connection, the valves 399 can block the fluidic connection until a rotation is effectuated to open the connection. In at least one example embodiment, a rotational connection such as, for example, a bayonet-type connection may effectuate opening of the valve 399. In at least one example embodiment, the vaporizing unit 20 can include proximal protruding elements 249 configured to be received in recesses 349 of a rotatable element that forms the valves 399. After the protruding elements 249 are received in recesses 349 upon connection of the vaporizing unit 20 and capsule 30, rotation of the capsule 30 relative to the vaporizing unit 20 can cause the valves 399 to open. Rotation in the opposite direction can cause the valves 399 to close prior to, or during, disconnection of the vaporizing unit 20 and capsule 30. The valves may be rotational valves as described in, for example, Chinese Published Patent Application, CN 104738816 A.

Also shown in FIGS. 1A and 1B are passageways for air or aerosol flow through the system 100. The vaporizing unit 20 comprises one or more inlets 244 (two shown) in housing 240 in communication with passageway 215 that extends to the proximal end of the vaporizing unit. A central passageway 315 extends through the capsule 30 and is in communication with the passageway 215 of the vaporizing unit 20 when the vaporizing unit 20 and capsule 30 parts are connected. The cover 40 comprises a central passageway 415. The central passageway 415 of the cover 40 is in communication with the central passageway 315 of the capsule 30 when the cover 40 is disposed over the capsule 30.

In at least one example embodiment, as shown in FIGS. 1A-C, the cover 40 is configured to be positioned over the vaporizing unit 20 and the capsule 30. In at least one example embodiment, a smooth surface transition is formed across the outer surface of the system 100 at the junction between the cover 40 and the first part 10. The cover 40 may be maintained in position in any suitable manner, such as such as threaded engagement, snap-fit engagement, interference-fit engagement, magnetic engagement, or the like to any one or more of the first part 10, vaporizing unit 20, or capsule 30 (engagement not shown).

Figure 2A:
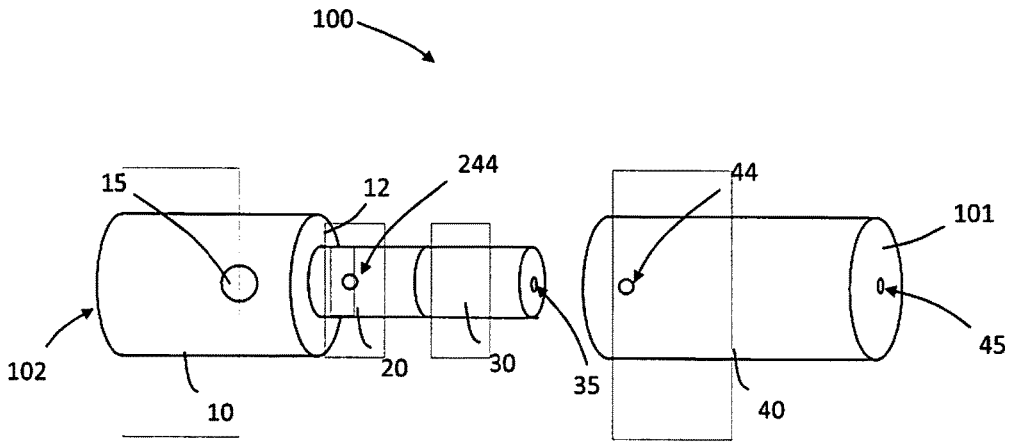
FIG. 2A is an illustration of the parts connected and the cover removed according to at least one example embodiment.
Figure 2B:
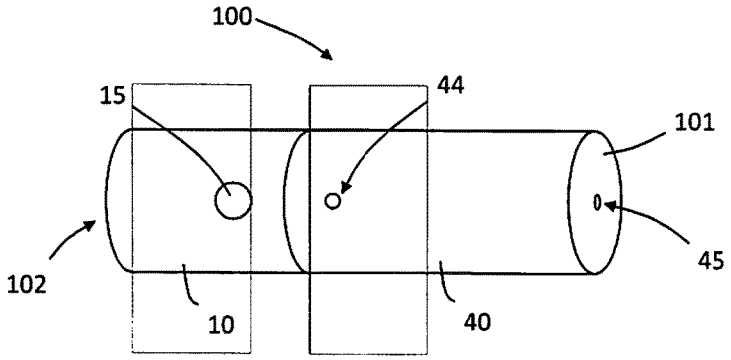
FIG. 2B is an illustration of the system with the cover secured in place according to at least one example embodiment.

In at least one example embodiment, as shown in FIGS. 2A-B, an aerosol generating system 100 includes a first part 10, a vaporizing unit 20, a capsule 30, and a cover 40. The parts are generally as described with regard to FIGS. 1A-C. In some example embodiments (not depicted), the parts of the vaporizing unit 20 may be included in a cartridge, and the system 100 would not include a separate vaporizing unit.

The connected system depicted in FIGS. 2A-B extends from a mouth end 101 to a distal end 102. The housing of the capsule 30 defines an opening 35 in communication with a passage through the length of the capsule 30. The passage defines a portion of an aerosol flow path through the system 100. The housing of the vaporizing unit 20 defines an air inlet 244 in communication with a passage through the vaporizing unit 20. The passage through the vaporizing unit 20 is in communication with the passage through the capsule 30. The cover 40, which is configured to cover the vaporizing unit 20 and the capsule 30, comprises a sidewall defining an air inlet 44 that is in communication with the air inlet 244 of the vaporizing unit 20 when the cover 40 is secured in place relative to the other parts of the system. The housing of the cover 40 also defines a mouth end opening 45 that is in communication with the passage through the capsule 30. Accordingly, when an adult vaper draws on the mouth end 101 of the system 100, air enters inlet 44 of cover 40, then enters the inlet 244 of the vaporizing unit 20, flows through the passage in the vaporizing unit 20, through the passage in the capsule 30, through the opening 35 at the proximal end of the capsule, and through the mouth end opening 45.

The first part 10 of the aerosol generating system depicted in FIGS. 2A-B includes a button 15 that may be depressed to activate, and optionally, to deactivate the system 100. The button 15 is coupled to a switch of the circuitry of the first part 10.

In at least one example embodiment, as shown in FIG. 2A, the housing of the first part 10 defines a rim 12 at the proximal end. The distal end of the cover 40 abuts the rim 12 when the cover 40 is secured in place over the vaporizing unit 20 and the capsule 30. In at least one example embodiment, the size and shape of the outer edge of the rim 12 of the housing of the first part 10 is substantially the same as the size and shape of the outer edge of the distal end of the cover 40 so that a smooth contour along the outer surface of the system is formed at the junction of the first part and the cover.

Figure 3:
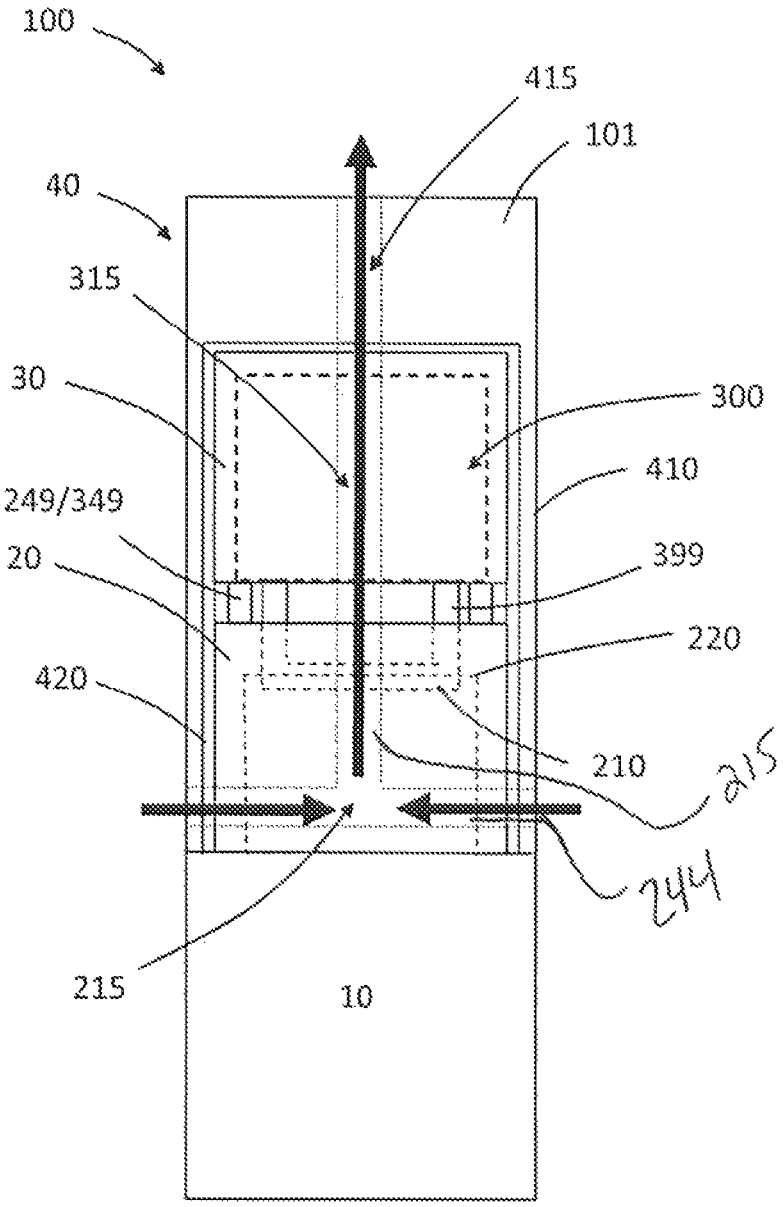
FIG. 3 is a schematic cross-sectional view of an aerosol generating system having connected parts and cover, and illustrating an aerosol flow path according to at least one example embodiment.

Referring now to FIG. 3, an aerosol flow path through the system 100 is illustrated by thick arrows. As in FIGS. 1A-C and 2A-B, the system 100 includes the first part 10, the vaporizing unit 20, the capsule 30, and the cover 40 disposed over the vaporizing unit 20 and the capsule 30 and in contact with a rim of the first part 10. When the parts of the system 100 are connected, the heating element 220 is coupled to control electronics and power supply (not shown) of the first part (shown in FIGS. 1A-C and 2A-B, and valves 399 are either immediately opened, or placed into an open position, to allow liquid aerosol generating substrate to flow to liquid transfer element 210. In some example embodiments (not depicted), the parts of the vaporizing unit may be included in a cartridge, and the system would not include a separate vaporizing unit.

When an adult vaper draws on the mouth end 101, air enters into the system through a sidewall 410 of the cover, such as through an air inlet 44 as depicted in FIG. 2A. The air may then flow into the vaporizing unit 20, such as through the inlet 244 as depicted in FIG. 2A, and through a passage 215 in vaporizing unit with which liquid transfer element 210 is in communication. The liquid transfer element 210 which carries the aerosol generating substrate may be heated by heating element 220 to cause aerosol to be generated from the heated substrate. The aerosol may be entrained in the air, which flows through a passage in the capsule 30, through a passage 415 in cover, and out of the mouth end 101, such as through mouth end opening 45 as depicted in FIG. 2B.

Figure 4:
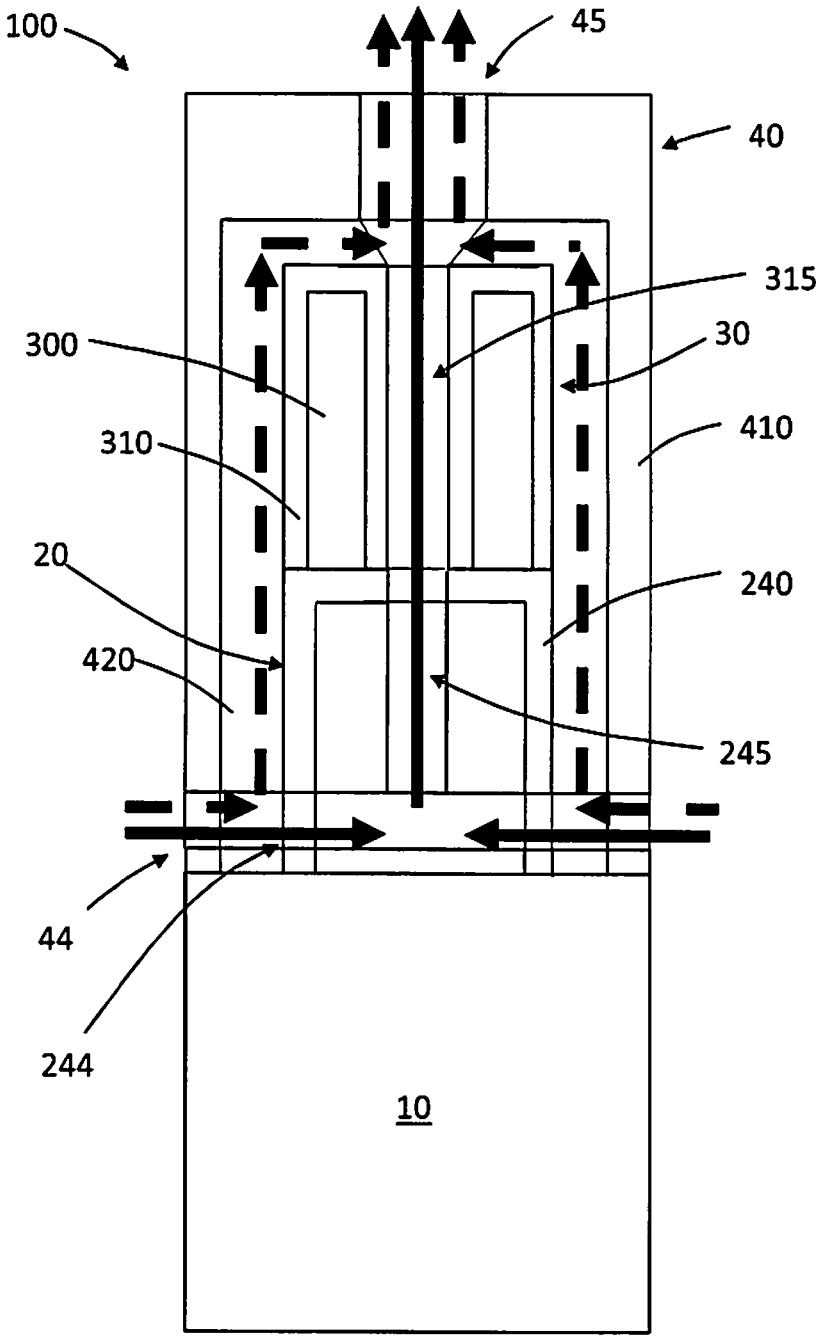
FIG. 4 is a schematic cross-sectional view of an aerosol generating system having connected parts and cover, and illustrating an aerosol flow path and an air flow path between the cover and the liquid storage portion according to at least one example embodiment.

In at least one example embodiment, as shown in FIG. 4, a system 100 includes a first part 10 containing a power supply and control circuitry (not shown), a capsule 30, a vaporizing unit 20, and a cover 40 is shown. An aerosol path through the system is shown in solid arrows. An air flow path through the system that travels in a space 420 defined between the cover 40 and the capsule 30 is shown in dashed arrows. The cover 40 comprises a housing 410 that defines an air inlet 44 near its distal end. The vaporizing unit 20 comprises a housing 240 that defines an air inlet 244 in communication with a passage 245 through the vaporizing unit 20. The passage 245 is in communication with a passage 315 defined by the housing 310 of the capsule 30, which also defines the reservoir 300. The passage 315 through the capsule 30 is in communication with the mouth end opening 45 defined in the housing 410 of the cover 40. The aerosol flow path may be substantially the same as described with regard to FIG. 3. In at least one example embodiment, when an adult vaper draws on the mouth end of the system 100, air enters the inlet 44 of the cover 40, flows through the inlet 244 of the vaporizing unit 20, through passage 245 in vaporizing unit 20 where aerosol generated by heating of substrate may be entrained in the air, which then flows through passage 315 through capsule 30 and out of mouth end opening 45.

When an adult vaper draws on the mouth end of the system 100, air is also pulled through inlet 44 defined by the housing 410 of the cover 40 and through the space 420 between the inner surface of the housing 410 of the cover 40 and the outer surface of the housing 310 of the capsule 30, and then out of the mouth end opening 45. This "air flow" path serves to inhibit condensation formation on the outside of the capsule 30.

While the air flow path and the aerosol flow path depicted in FIG. 4 are shown as sharing the inlet 44 and the outlet 45, it will be understood that the different flow paths may have different inlets, different outlets, or different inlets and outlets.

The space 420 or clearance between the inner surface of the housing 410 of the cover 10 and the outer surface of the housing 310 of the capsule 30 may be increased or decreased as desired to change the resistance-to-draw through air flow path. In some example embodiments, the space 420 between the cover and the capsule 30 is open all the way around the capsule 30 so that the space 420 forms a single "channel."

Figure 5:
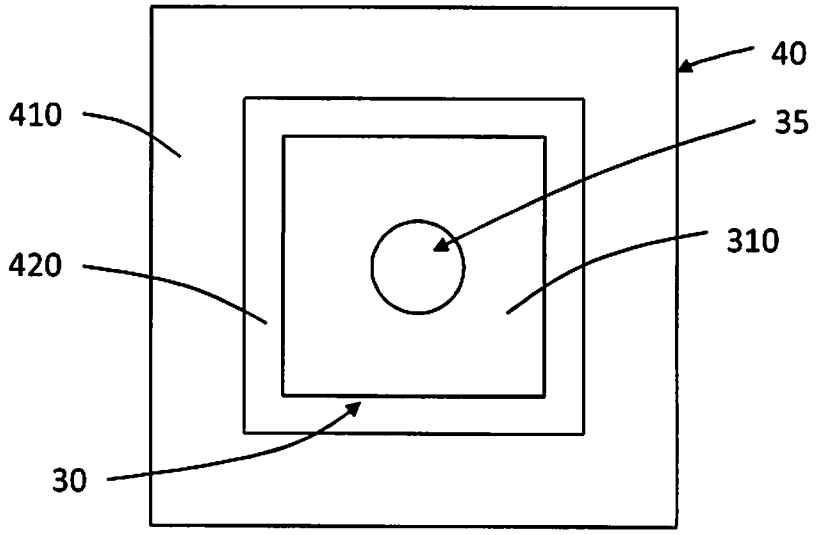
FIGS. 5-8 are schematic cross-sectional views showing channels formed between the cover and the liquid storage portion according to at least one example embodiment.

FIG. 5, a schematic cross-sectional view taken at the proximal end of the capsule 30, in which a single channel is formed in the space 420 between the inner surface of the housing 410 of the cover 10 and the outer surface of the housing 310 of the capsule 30. Proximal end opening 35 of capsule 30 is also shown.

In other example embodiments, one or both of the inner surface of the housing 410 of the cover 40 and the outer surface of the housing 310 of the capsule 30 may include one or more detents (such as ridges that may form grooves) that may form one or more channels when the cover 40 is disposed over the capsule 30. In addition or alternatively, one or more additional pieces may be disposed between the cover 40 and the capsule 30 to restrict flow as desired.

Figure 6:
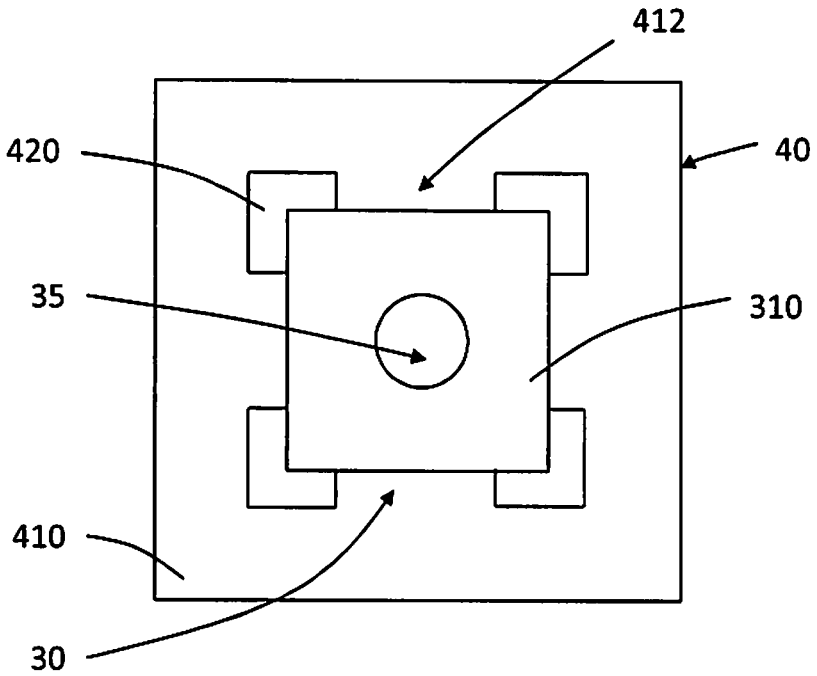
Figure 7:
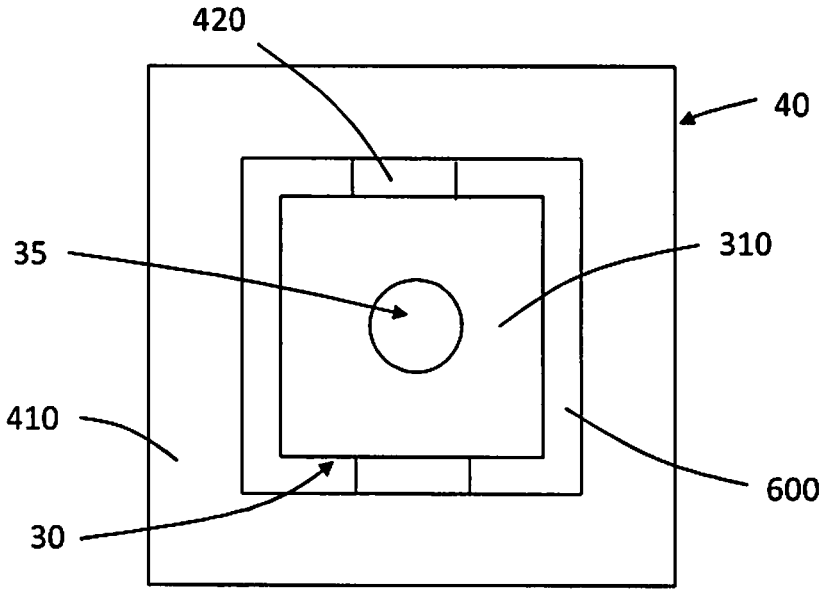
Figure 8:
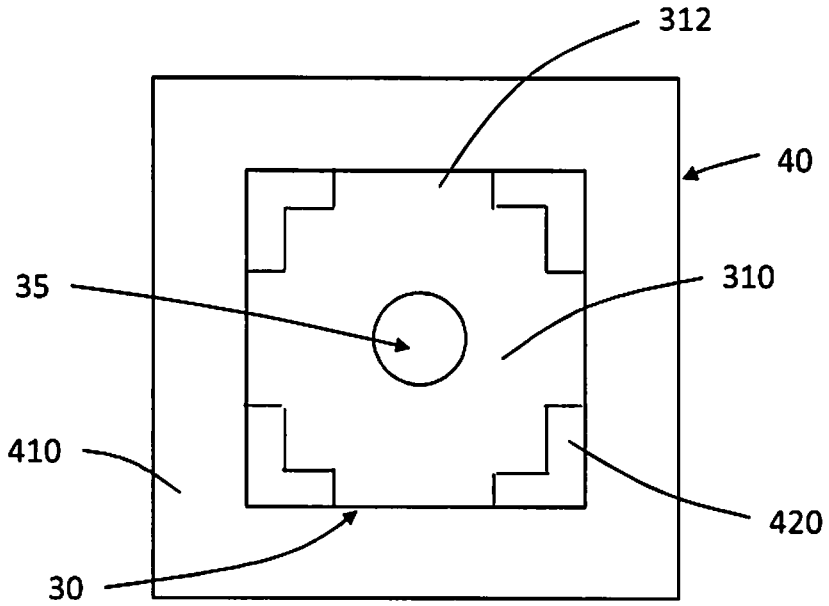

Some example embodiments are shown in FIGS. 6-8, in which cross-sectional views taken at the proximal end of the capsule 30 are shown. In FIGS. 6-8 proximal end opening 35 of capsule 30 is shown.

In FIG. 6, the inner surface of the housing 410 of the cover 40 includes detents 412 that contact, or come in close proximity to, the outer surface of the housing 310 of the capsule 30 to form air flow channels 420 between the cover 40 and the capsule 30.

In FIG. 7, pieces 600, such as seals, are positioned between and in contact with, or in close proximity to, the inner surface of the housing 410 of the cover 40 and the outer surface of the housing 310 of the capsule 30 to form air flow channels 420 between the cover 40 and the capsule 30 around pieces 600.

In FIG. 8, the outer surface of the housing 310 of the capsule 30 includes detents 312 that contact, or come in close proximity to, the inner surface of the housing 410 of the cover to form air flow channels 420 between the cover and the capsule.

Figure 9:
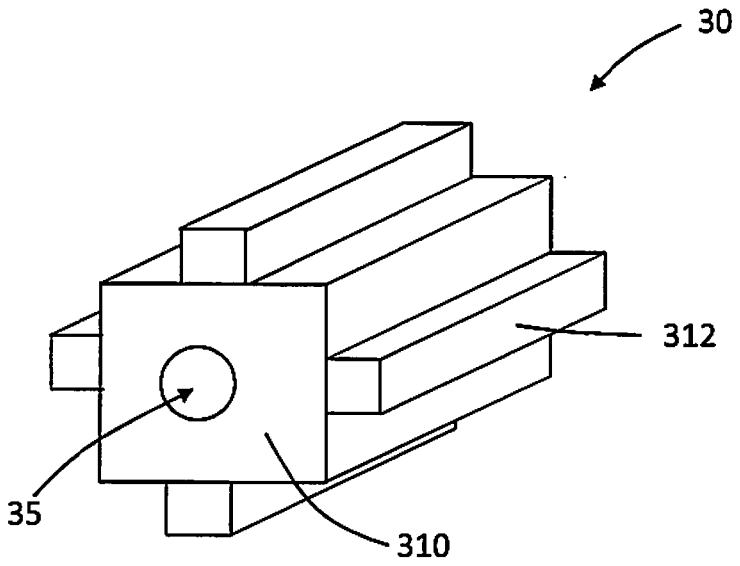
FIG. 9 is a schematic perspective view of a liquid storage portion having ridges or detents for cooperating with a cover for forming air flow channels according to at least one example embodiment.

Referring now to FIG. 9, a capsule 30 may include one or more detents 312 or ridges extending from the housing 310. The ridges 312 are configured to interact with an inner surface of a cover to form air flow channels, such as depicted in FIG. 8. The depicted ridges 312 extend the length of the capsule. In some example embodiments (not shown), the ridges 312 may extend around the capsule in helical manner.

Figure 10:
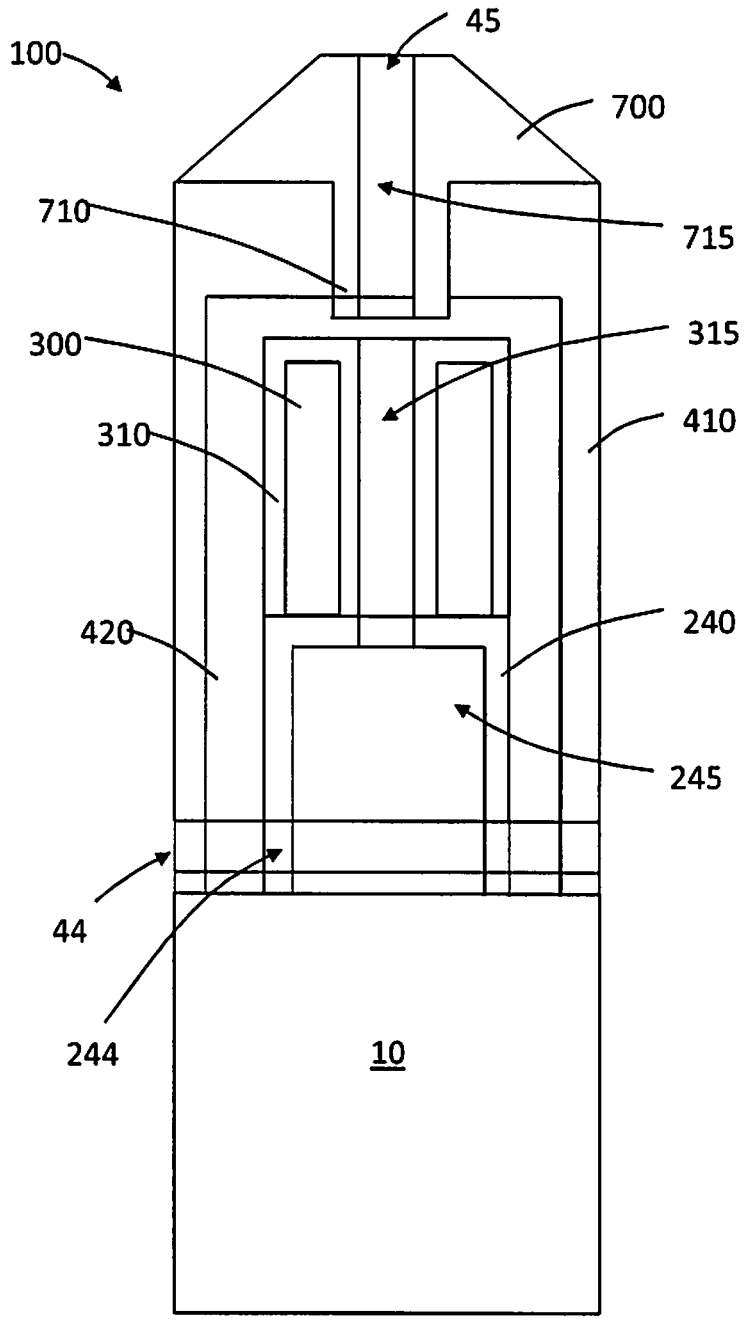
FIG. 10 is a schematic cross-sectional view of an aerosol generating system having a cover comprising a mouth tip that, at least in part, defines relative flow between an air flow path and an aerosol flow path according to at least one example embodiment.

Referring now to FIG. 10, a system 100 having a cover that comprises a mouth tip 700 is shown. Many of the parts depicted in FIG. 10 are the same or similar to those depicted in, and described with regard to, FIG. 4. Reference is made to the discussion above regarding FIG. 4 for numbered elements depicted in, but not specifically discussed with regard to, FIG. 10. Mouth tip 700 defines mouth end opening 45 of the cover. The mouth tip 700 also defines a passage 715 in communication with the mouth end opening 45 and the air flow path and the aerosol path. The mouth tip 700 sealingly engages a proximal end opening in housing 410 of the cover. A distal end portion 710 of mouth tip 700 extends into the space 420 between the inner surface of the housing 410 of the cover and the outer surface of the housing 310 of the capsule to restrict flow through the air flow path.

It will be understood that the various flow restriction mechanisms depicted in FIGS. 5-10 are merely example embodiments of the ways in which flow can be restricted to obtain a desired resistance-to-draw and relative flow between the air flow path and the aerosol flow path. Other mechanisms and features for accomplishing desired resistance to draw and relative flow between the air flow path and the aerosol flow path are contemplated.

Figure 11A:
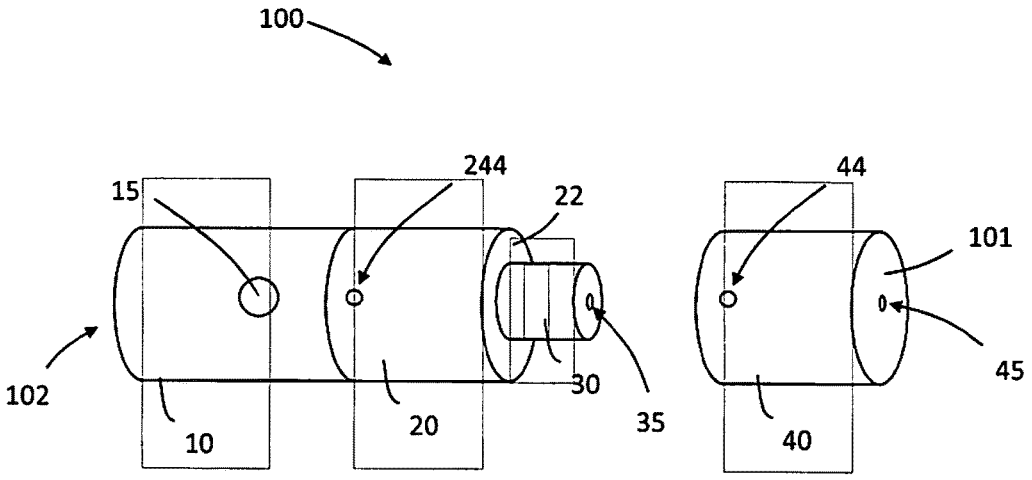
FIG. 11A is an illustration of the parts connected and the cover removed according to at least one example embodiment.
Figure 11B:
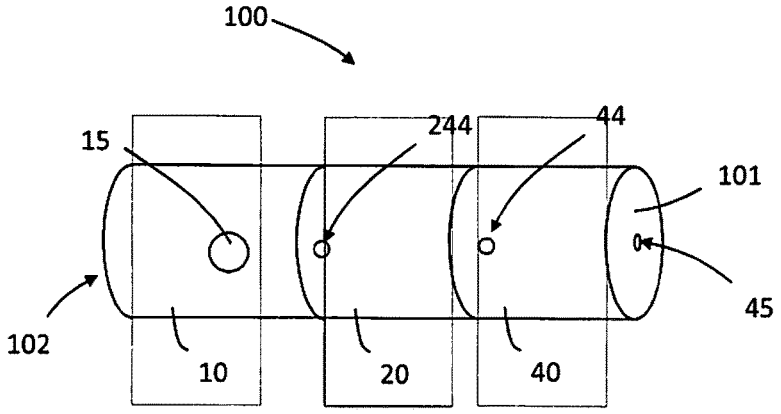
FIG. 11B is an illustration of the system with the cover secured in place according to at least one example embodiment.

Referring now to FIGS. 11A-B, an aerosol generating system 100 in which the cover 40 is configured to cover the capsule 30, but not the vaporizing unit 20, is shown. Many of the parts depicted in FIGS. 11A-B, are the same or similar to those depicted in, and described with regard to, FIGS. 2A-B. Reference is made to the discussion above regarding FIGS. 2A-B for numbered elements depicted in, but not specifically discussed with regard to, FIGS. 11A-B. In the system 100 depicted in FIGS. 11A-B, the distal end of the cover 40 engages a rim 22 on the proximal end of the housing of the vaporizing unit 20. Because cover 40 does not cover the distal portion of the vaporizing unit 20, aerosol flow path and the air flow path may have separate air inlets. In at least one example embodiment, the air inlets 244 may serve as inlets for the aerosol flow path, and inlets 44 may serve as inlets for the air flow path. The relative size of the inlets 44 and the inlets 244 may, in part, define resistance-to-draw of the aerosol flow path and the air flow path and thus relative flow between the paths.

Various modifications and variations will be apparent to those skilled in the art without departing from the scope and spirit of the invention. Although the invention has been described in connection with specific example embodiments, it should be understood that the invention as claimed should not be unduly limited to such example embodiments. Indeed, various modifications of the described modes for carrying out the invention which are apparent to those skilled in the mechanical arts, electrical arts, and aerosol generating article manufacturing or related fields are intended to be within the scope of the following claims.

I claim:

1. An aerosol generating system having a mouth end and a distal end, the system comprising:

a liquid storage portion configured to contain an aerosol generating substrate, the liquid storage portion including at least one detent extending from a surface of the liquid storage portion;

a heating element configured to heat the aerosol generating substrate;

a cover over at least the liquid storage portion; and one or more air flow channels between the cover and the liquid storage portion, the system defining an aerosol flow path that extends at least from the heating element to the mouth end of the system, and defining an air flow path through the one or more air flow channels extending from at least the liquid storage portion to the mouth end of the system, and the at least one detent forming at least a portion of the one or more air flow channels.

2. The system according to claim 1, wherein the air flow path passes over an exterior surface of the liquid storage portion.

3. The system according to claim 1, wherein the liquid storage portion comprises, a housing defining a passage through a length of the housing, aerosol flow path extending through the passage of the housing.

4. The system according to claim 1, wherein the cover comprises, a mouthpiece defining the mouth end of the system, the mouthpiece defining a mouth end opening that forms a part of the air flow path and a part of the aerosol flow path.

5. The system according to claim 1, wherein a resistance-to-draw of the system is in a range of from about 50 millimeters water gauge (mmWG) to about 150 mmWG.

6. The system according to claim 5, wherein the resistance-to-draw of the system is in a range of from about 75 mmWG to about 110 mmWG.

7. The system according to claim 1, wherein the system is configured such that a volume of air that flows through the air flow path is less than the volume of air that flows through the aerosol flow path.

8. The system according to claim 1, wherein the cover comprises, one or more detents extending from an interior surface of the cover, the one or more detents forming at least a portion of the one or more air flow channels.

9. The system according to claim 1, wherein the liquid storage portion is replaceable.

10. The system according to claim 1, wherein the liquid storage portion and the heating element are part of a replaceable cartridge.

11. The system according to claim 10, wherein the replaceable cartridge further comprises, a liquid transfer element in contact with the heating element.

12. The system according to claim 9, wherein the system further comprises:

a vaporizing unit releasably coupleable to the liquid storage portion, the vaporizing unit including the heating element.

13. The system according to claim 1, wherein the aerosol flow path comprises an aerosol flow path inlet, the one or more air flow paths comprise at least one air flow path inlet, and the air flow inlet and the aerosol flow inlet are the same or different inlets.

14. A cover for an aerosol generating system including a consumable liquid supply portion, the cover comprising:

a housing; and at least one detent extending from an interior surface of the housing, the at least one detent configured to interact with the liquid storage portion to form one or more air flow channels between the housing and the liquid storage portion when the liquid storage portion and the cover are assembled in the system.

15. An aerosol generating system having a mouth end and a distal end, the system comprising:

a liquid storage portion configured to contain an aerosol generating substrate;

a heating element configured to heat the aerosol generating substrate;

a cover over at least the liquid storage portion, the cover including, at least one detent extending from an interior surface of the cover; and one or more air flow channels between the cover and the liquid storage portion, the system defining an aerosol flow path that extends at least from the heating element to the mouth end of the system, and defining an air flow path through the one or more air flow channels extending from at least the liquid storage portion to the mouth end of the system, and the at least one detent forming at least a portion of the one or more air flow channels.

16. An aerosol generating system having a mouth end and a distal end, the system comprising:

a liquid storage portion configured to contain an aerosol generating substrate, the liquid storage portion being replaceable;

a vaporizing unit configured to be coupled to the liquid storage portion, the vaporizing unit including a heating element configured to heat the aerosol generating substrate;

a cover over at least a portion of the liquid storage portion; and one or more air flow channels between the cover and the liquid storage portion, the system defining an aerosol flow path that extends at least from the heating element to the mouth end of the system, and defining an air flow path through the one or more air flow channels extending from at least the liquid storage portion to the mouth end of the system.

* * * * *